US011234322B2

(12) United States Patent
Maji et al.

(10) Patent No.: US 11,234,322 B2
(45) Date of Patent: Jan. 25, 2022

(54) LIGHTING DEVICE WITH CONNECTIVITY TEST ROUTINE FUNCTION CAPABILITY

(71) Applicant: SIGNIFY HOLDING B.V., Eindhoven (NL)

(72) Inventors: Goutam Maji, Bangalore (IN); Matthias Wendt, Würselen (DE); Eduard Gerhard Zondag, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/253,859

(22) PCT Filed: Jun. 11, 2019

(86) PCT No.: PCT/EP2019/065174
§ 371 (c)(1),
(2) Date: Dec. 18, 2020

(87) PCT Pub. No.: WO2019/243111
PCT Pub. Date: Dec. 26, 2019

(65) Prior Publication Data

US 2021/0274626 A1 Sep. 2, 2021

(30) Foreign Application Priority Data

Jun. 18, 2018 (IN) ..... 201841022644
Aug. 3, 2018 (EP) ..... 18187259

(51) Int. Cl.
*H05B 47/19* (2020.01)
*H05B 45/10* (2020.01)

(52) U.S. Cl.
CPC ..... *H05B 47/19* (2020.01)

(58) Field of Classification Search
CPC ..... H05B 45/10; H05B 45/20; H05B 45/37; H05B 45/50; H05B 47/14; H05B 47/19;
(Continued)

(56) References Cited

U.S. PATENT DOCUMENTS 6,236,863 B1 5/2001 Waldroup et al.
8,773,827 B2 * 7/2014 Kiko ..... H02J 3/14 361/62

(Continued)

FOREIGN PATENT DOCUMENTS

WO 2007040398 A1 4/2007
WO 2019234093 A1 12/2019

*Primary Examiner* — Haissa Philogene

(57) ABSTRACT

The invention relates to a lighting device (200), which comprises a power input (202) unit for reception of primary operating power from an external primary power supply, a lighting control unit (204) configured to control a lighting function of the lighting device, a secondary power supply unit (206) for storing operating energy and providing secondary operating power in absence of reception of the primary operating power, a wireless-transceiver unit (208), which is configured, in performing a pre-installation connectivity test routine under supply of only the secondary operating power, to generate and transmit, upon detecting reception of a trigger input signal (210), a first wireless test signal (212), to monitor for reception of a second wireless test signal (214) from an external wireless-transceiver unit; and to determine whether or not the received second wireless test signal fulfills predetermined test-signal criteria and to provide an output signal indicative thereof.

14 Claims, 6 Drawing Sheets

(58) Field of Classification Search
CPC .... H05B 47/105; H05B 47/195; G01R 21/00; G01R 21/133; G01R 31/3187; G01R 31/327; H02J 9/065; H02J 50/40; H02J 13/00006; H02J 13/0017; F21S 9/02; Y02B 20/40
See application file for complete search history.

(56) References Cited

U.S. PATENT DOCUMENTS

| | | | | |
|---|---|---|---|---|
| 9,432,259 | B1 | 8/2016 | Hutz et al. | |
| 9,629,220 | B2 * | 4/2017 | Panopoulos | B64F 1/00 |
| 9,655,217 | B2 | 5/2017 | Recker et al. | |
| 9,867,263 | B2 * | 1/2018 | Avrahamy | C02F 1/42 |
| 11,119,154 | B1 * | 9/2021 | De Cicco | H05B 45/37 |
| 2007/0066259 | A1 | 3/2007 | Ryan et al. | |
| 2008/0240031 | A1 | 10/2008 | Nassiri-Toussi et al. | |
| 2012/0082062 | A1 | 4/2012 | Mccormack | |
| 2014/0192189 | A1 * | 7/2014 | Hsieh | H04N 7/183 348/143 |
| 2014/0354161 | A1 | 12/2014 | Aggarwal et al. | |
| 2016/0330824 | A1 | 11/2016 | Recker et al. | |
| 2017/0171949 | A1 | 6/2017 | Kim et al. | |

* cited by examiner

LIGHTING DEVICE WITH CONNECTIVITY TEST ROUTINE FUNCTION CAPABILITY

CROSS-REFERENCE TO PRIOR APPLICATIONS

This application is the U.S. National Phase application under 35 U.S.C. § 371 of International Application No. PCT/EP2019/065174, filed on Jun. 11, 2019, which claims the benefit of Indian Patent Application No. 201841022644, filed on Jun. 18, 2018 and European Patent Application No. 18187259.9, filed on Aug. 3, 2018. These applications are hereby incorporated by reference herein.

FIELD OF THE INVENTION

The present invention relates to a lighting device, to a lighting device arrangement and to a method for operating a lighting device.

BACKGROUND OF THE INVENTION

US 2014/0354161 A1 describes networked intelligent lighting devices and other elements connected to the network of a lighting system which are adaptable to desirable networking arrangements as well as logical functional groups, for example by each storing communication provisioning data and/or configuration data for logically associating system elements into one or more groupings or subnetworks. The systems and system elements also enable such enhanced network arrangement via autonomous discovery and device commissioning. Autonomous discovery requires a connectivity between the corresponding devices.

US 2016/330824 A1 describes a wireless lighting device comprising a battery which responds to commands received from a beaconing wireless transmitter device if the proximity of the beaconing wireless transmitter device to the at least one wireless lighting device is within a predetermined range.

US 2012/082062 A1 describes a wireless network system in which a network device a joining device operate in a discovery mode, in which the joining device broadcasts a discovery message and the network device, upon reception of said discovery message, enters a commissioning mode. In this commissioning mode the network device provides joining information to said joining device.

SUMMARY OF THE INVENTION

It would be beneficial to provide lighting devices that allow reducing an installation effort.

According to a first aspect of the present invention, a lighting device is disclosed. The lighting device comprises a power input unit for reception of primary operating power from an external primary power supply. The lighting device also comprises a lighting control unit which is connected to the power input unit and configured to control a lighting function of the lighting device under reception of the primary operating power, and a secondary power supply unit for storing operating energy and providing secondary operating power in absence of reception of the primary operating power. Further, the lighting device comprises a wireless-transceiver unit, which is configured, in performing a pre-installation connectivity test routine under supply of only the secondary operating power:

to generate and transmit, upon detecting reception of a trigger input signal, a first wireless test signal;

to monitor for reception of a second wireless test signal from an external wireless-transceiver unit; and upon reception of the second wireless test signal, to determine whether or not the received second wireless test signal fulfills predetermined test-signal criteria and to provide an output signal indicative thereof.

The lighting device of the first aspect of the present invention is based on the recognition that, once a lighting device is installed at the intended position, changing a location, orientation or operation parameters of its wireless transceiver unit for improving or otherwise adapting its connectivity with other devices is both difficult and time consuming.

The lighting device of the first aspect of the invention is thus configured to perform a lighting function under provision of primary operating power from an external primary power supply. The lighting function is performed under control of the lighting control unit. In addition to connectivity to the external primary power supply, the lighting device also provides a secondary power supply that stores operating energy to provide secondary operating power in absence of reception of the primary operating power. The secondary operating power is advantageously used to power a wireless transceiver unit in performing a pre-installation connectivity test routine. Thus, the pre-installation connectivity test routine can advantageously be performed even in absence of provision of primary operating power, and in particular when the lighting device is not installed at an intended position.

In other words, the lighting device of the first aspect of the invention enables the performance of a pre-installation connectivity test routine without requiring any primary operating power, namely, under supply of only secondary operating power provided by the secondary power supply unit that stores operating energy. This allows performing the pre-installation connectivity test routine before the lighting devices will be installed at the intended position.

The pre-installation connectivity test routine serves for testing a connectivity of the lighting device for wireless communication with external devices, which may in particular include peer lighting devices or other devices such as network control device, with or without lighting function. The pre-installation connectivity test routine is designed to ensure that lighting device is able to perform wireless communication with any such external device according to predetermined criteria, fulfillment of which is tested by the test-signal criteria during the pre-installation test routine. In performing this test routine, the lighting device generates and transmits, upon detecting reception of a trigger input signal, a first wireless test signal, and monitors the wireless transmission medium for reception of a second wireless test signal from an external wireless-transceiver unit. Upon reception of the second wireless test signal, the lighting device determines whether or not the received second wireless test signal fulfills predetermined test-signal criteria and to provide an output signal indicative thereof. Thus, the output signal is indicative of whether or not the lighting device has received a signal fulfilling the test-signal criteria regarding its signal parameters, and allows determining if wireless connectivity with another device can be established.

In the following, embodiments of the lighting device of the first aspect of the present invention will be described.

It is noted that it is not a requirement that the second wireless test signal is sent as a response to the first wireless test signal. Some embodiments do adhere to a test protocol that involves providing the second wireless test signal as a dedicated response to the first wireless test signal. Other embodiments, however, provide for mutually independent transmissions of the first and wireless test signals, which in particular does not require observing any timely order between the first and second wireless test signals. In this latter type of embodiments, the monitoring for reception of the second wireless test signal may even start before the first wireless test signal is generated and transmitted.

The trigger signal is in an embodiment a manual activation of a switch. In other embodiments, wherein the lighting device is packed in a packing box, the trigger signal is activated upon a detection of an unpacking of the lighting device. In yet other embodiments, the lighting device comprises a sensor that provides the trigger signal upon detecting that a predetermined side of the lighting device has been positioned onto an external surface such as, for instance, a floor or a table.

One embodiment of the lighting device is advantageously configured to adapt the wireless-transceiver unit when the test-signal criteria have not been fulfilled. In an exemplary embodiment, non-fulfillment of the test-signal criteria means that the second wireless-test signal has not been received within a predetermined time span.

Another exemplary embodiment implements test-signal criteria that, as an alternative or in addition to the previously mentioned criteria, determine non-fulfillment if a second wireless-test signal is received outside a predetermined communication frequency band, or exhibits a signal quality that is lower than a predetermined signal-quality threshold, as determined using a suitable signal quality measure, such as a signal power, a signal energy, a signal-to-noise ratio or other suitable measure. Another test-signal criterion that is used in addition or as an alternative in some embodiments requires the second test signal to be in accordance with requirements of a predetermined communication protocol.

In some embodiments, the wireless-transceiver unit comprises a receiver unit that has one or more adaptable receiver features and a transceiver control unit which is configured to adapt at least one of the one or more receiver features in response to the output signal indicating non-fulfillment of the test-signal criteria.

For instance, the receiver unit comprises a reception amplifier unit having a controllable amplifier gain as one of the adaptable receiver features. In this embodiment, the transceiver control unit is configured to increase the amplifier gain of the reception amplifier unit in response to the output signal indicating non-fulfillment of the test-signal criteria.

In another embodiment, the wireless transceiver unit additionally or alternatively comprises a transmitter unit having one or more transmitter features. In this embodiment, the transceiver unit is additionally or alternatively configured to adapt at least one of the one or more transmitter features in response to the output signal indicating non-fulfillment of the test-signal criteria.

In an embodiment the receiver unit additionally, or alternatively, has a controllable reception field distribution forming one of the adaptable receiver features. In this embodiment the transceiver control unit is additionally or alternatively configured to change the reception field distribution of the receiver unit in response to the output signal indicating non-fulfillment of the test-signal criteria. For instance, in an embodiment, the receiver unit comprises a plurality of reception antennas being arranged so that each antenna has a different orientation and thus a different antenna-reception field. In this particular embodiment, the reception field distribution of the receiver is adapted by selecting one or a combination of two or more antennas for actively receiving the second wireless-test signal. In another embodiment the plurality of antennas form a phased array configured to adapt the reception field distribution.

Another embodiment, which comprises a transmitter unit either in addition to the receiver unit or as an alternative to the receiver unit, has a controllable transmission field distribution forming one of the adaptable transmitter features. In this embodiment, the transceiver control unit is—additionally or alternatively—configured to change the transmission field distribution in response to the output signal indicating non-fulfillment of the test-signal criteria.

As mentioned, the non-fulfillment of the test criteria may be caused by an external wireless-transceiver unit not transmitting the second wireless test signal with sufficient transmission power or, more generally speaking, transmission energy. Thus, in another embodiment, the wireless transceiver unit is configured, upon detecting non-fulfillment of the test-signal criteria, and in addition or as an alternative to its capabilities of performing receiver adaptation, to generate and transmit a power-increase signal indicative of an instruction to a transceiver unit of an external peer device to increase a transmission energy of the second wireless test signal. An increase in transmission energy is requested in different variants by an increase in transmission power (under constant signal duration), an increase in signal duration (under constant transmission power), or both.

Another embodiment of the lighting device is configured, upon detecting a power-increase signal from an external wireless-transceiver unit, to increase a transmission energy of the first wireless test signal. Additionally, or alternatively, in another embodiment, the wireless-transceiver unit is configured to increase the transmission energy of the first wireless test signal to a predetermined transmission energy value upon detecting non-fulfillment of the test-signal criteria.

In an embodiment of the lighting device, the wireless-transceiver unit is configured to initially set the transmission energy (see above for implementation options) of the first wireless test signal to a predetermined minimum value while operating under the secondary operating power during performance of the pre-installation connectivity test routine. This allows keeping the energy requirement low on the secondary power supply unit before installation. On the other hand, this generates an initial "worst-case" test during the pre-installation connectivity test routine which increases a prediction quality for well-functioning connectivity under normal operation conditions after installation. The transmission energy may be increased in this embodiment if necessary for fulfilling the test-signal criteria.

In another embodiment, the lighting device further comprises a user interface connected to the secondary power supply unit and configured to receive the output signal and to provide a perceivable output indicative thereof. In a particular embodiment, the user interface comprises a signaling light source, for instance a light-emitting diode (LED), and the perceivable output is achieved by emission of light from the LED. Other embodiments comprise an alternative type of user interface which is configured to provide an acoustic signal. In another embodiment, the user interface is additionally configured to transmit a wireless output signal. This wireless output signal is advantageously received at an external device which in turn provides a perceivable output to a user.

In a particular embodiment, the test-signal criteria are based on a received signal strength, and the user interface comprises a display that is configured to provide a perceivable output indicative of the received signal strength. As a non-limiting example, the user interface comprises a red LED, a yellow LED and a green LED. Insufficient signal strength in terms of the test criteria is indicated by the red LED. Received signal strength fulfilling the test criteria but belonging to a critical value range wherein a reduction of the received signal strength by a predetermined critical signal-strength amount would result in non-fulfillment of the test-signal criteria is indicated by the yellow LED. The green LED indicates that the test-signal criteria are fulfilled and that a difference between the received signal strength and a minimum required signal strength for fulfilling the signal test criteria is equal to or greater than the predetermined critical signal-strength amount. This thus helps the installer to immediately see the impact of adjustment actions like turning the lighting or moving to a different position.

If multiple second wireless test signals are received from different other lighting devices, and a single link is sufficient for operation, the perceivable output is indicative of the signal strength of the strongest received second wireless test-signal.

In an exemplary embodiment in which the fulfillment of the signal test criteria requires receiving two second wireless test signals (e.g., because the communication network requires at least two links), the perceivable output is indicative of the second highest received signal strength. For instance, an active red LED indicates that the received highest signal strength does not fulfill the test-signal criteria, whereas an active green LED indicates that the second highest signal strength fulfills the signal-test criteria, and an active yellow LED indicates that the highest received strength signal fulfills the test-signal criteria but not enough second wireless test signals with sufficient signal quality are received.

An alternative perceivable output is for instance an LED that is activated with the trigger and that only extinguishes when the test-signal criteria have been fulfilled.

In another embodiment, the wireless-transceiver unit is alternatively or additionally configured to establish, in compliance with a predetermined network protocol, a networking connection with one or more external wireless-transceiver units under provision of power from only the secondary power supply unit. The establishment of the networking connection in accordance with the predetermined network protocol enables for instance a further exchange of information regarding peer devices in the network that comprise the different wireless transceiver units. This information may include, but is not limited to, product number and type of the device, data of fabrication of the device, battery status data, installed firmware data, current position data. The establishment of the networking connection may include a negotiation process for assigning one or more peer devices as a router or coordinator device. Also the topology of the networking connection is defined, for instance a star network, a mesh network, etc. A wireless mesh network (e.g. ZigBee, Bluetooth, WiFi) is a suitable network architecture enabling the connection of many devices. It is less expensive, highly expandable and highly reliable. In mesh networking systems, information travels by being bounced automatically from one router node to the next until it reaches its destination. Creating the networking connection is particularly suitable when the lighting devices are placed on the floor at locations corresponding to intended installation locations, for example beneath an intended ceiling installation location.

The trigger signal is, for example, provided to the one or more lighting devices sequentially to create the intended networking connection. Alternatively, the lighting devices are programmed to create the networking connection upon receiving the trigger signal. These exemplary tasks can be easily performed as the lighting devices are placed, for instance on the floor, or in easily accessible height, and powered with the secondary power supply unit.

In another embodiment, the lighting device of the first aspect comprises an operation control unit, which is connected with the power input unit and to the secondary power supply unit and configured:

to control operation of the lighting device in a first operational mode, which is associated with reception of the primary operating power via the power input unit and in which operation of the lighting control unit is allowed, and, to control operation of the lighting device in a second operational mode, which is associated with provision of only the secondary operating power in absence of reception of the primary operating power, and in which operation of the wireless-transceiver unit for performing the pre-installation connectivity test routine is allowed, but operation of the lighting control unit is not allowed.

Preferably, in an embodiment of the lighting device, the secondary power supply unit comprises a battery for storing the operating energy and providing the secondary operating power. The battery is suitable rechargeable and the secondary power supply unit connected to the power input unit for receiving power to charge the battery in operation of the lighting device. In simpler embodiment, the battery in not rechargeable. In this case, the secondary power supply unit is preferable designed to allow an easy access for installation or replacement of the battery.

In a preferred embodiment, the wireless-transceiver unit is additionally connected to the power input unit for receiving the primary operating power. In this embodiment, the wireless-transceiver unit is configured to transmit and receive wireless signals in accordance with a predetermined wireless communication protocol using the primary operating power from the external primary power supply.

In another embodiment, the lighting control unit is additionally connected to the secondary power supply unit. This is advantageous for lighting devices configured to operate as emergency lighting devices and perform, under control of the lighting control unit, an emergency lighting function using the secondary operating power from the secondary power supply unit.

According to a second aspect of the invention, a lighting device arrangement is disclosed. The lighting device arrangement comprises a plurality of lighting devices in accordance with the first aspect or any of its embodiments, and thus shares the advantages of the lighting devices of the first aspect of the invention described above.

The distance between transmitter and receiver is an important boundary condition for selecting suitable values of transmit power, wireless frequency bandwidth, polarization (linear, circular or elliptical polarization), etc. To overcome the distance limitation, a wireless mesh network is preferred since it is typically less expensive, highly expandable and highly reliable. For instance, connectivity between lighting devices or between lighting devices and an external central control unit or both can be advantageously tested by and verified before installation under provision of only the secondary operating power from the secondary power supply unit when the lighting devices are not yet installed. Suitably, the lighting devices of the arrangement are placed on the floor underneath a planned mounting position and need not be connected to the primary power supply, which for instance is mains power. In case the pre-installation connectivity test determines a missing connectivity or a poor connectivity in view of the predetermined test-signal criteria, a respective lighting device provides an output signal indicative thereof.

In an embodiment of the lighting device arrangement, one or more of the lighting devices comprise an interface unit configured to provide a perceivable output, for instance a signal light blinking with a predefined blinking pattern or an acoustic signal, which indicates to installation staff that this particular lighting device has not received a suitable second wireless-test signal. This supports the installer to adjust the wireless transceiver unit of the lighting device, for instance by changing a position of the lighting device or its orientation in space, or any other of the measures mentioned hereinabove. Given a suitable embodiment of the lighting device, the installer may adjust a position or orientation of an antenna of the wireless-transceiver unit or adjust a gain or install additional external antennas or change to a high-power antenna to improve connectivity or optimize the antenna power. As no primary operating power is provided at this state, even rotating the lighting device into an optimal direction is possible. In other embodiments, the lighting devices are suitably configured to adapt at least one of the one or more receiver features in response to the output signal indicating non-fulfillment of the test-signal criteria. By using any of these particular embodiments of lighting devices in the lighting device arrangement, an involvement of the installer is reduced, since the lighting devices are capable of actively adapting the receiver features to increase the chances of receiving a second wireless-test signal fulfilling the test-signal criteria.

In accordance with a third aspect of the present invention, a method for operating a lighting device is provided. The method comprises:

providing a lighting control unit for controlling a lighting function of the lighting device under reception, via a power input unit, of primary operating power from an external primary power supply;

providing, in absence of a connection to the primary power supply device, secondary operating energy from a secondary power supply unit to wireless-transceiver unit;

performing a pre-installation connectivity test routine under supply of only the secondary operating power, wherein the pre-installation connectivity test routine comprises;

detecting reception of a trigger input signal;

generating and transmitting a first wireless test signal;

monitoring for reception of a second wireless test signal from an external wireless-transceiver unit; and determining and providing an output signal indicative of whether or not the received second wireless test signal fulfills predetermined test-signal criteria.

The method of the third aspect shares the advantages of the lighting device of the first aspect and of any of its embodiments.

In the following, embodiments of the method of the third aspect are described.

In an embodiment, the method of the third aspect further comprises adapting at least one adaptable receiver feature of a receiver unit of the wireless-transceiver unit or at least one adaptable transmitter feature of a transmitter unit of the wireless-transceiver unit in response to the output signal indicating non-fulfillment of the test-signal criteria.

In another embodiment, the method of the third aspect alternatively or additionally comprises, upon detecting non-fulfillment of the test-signal criteria, generating and transmitting a power increase signal indicative of an instruction to increase a transmission energy of the second wireless test signal.

In another embodiment, the method additionally or alternatively comprises providing a perceivable output indicative of the output signal.

In yet another embodiment, the method of the third aspect additionally or alternatively comprises establishing, in compliance with a predetermined network protocol, a networking connection with one or more external wireless-transceiver units under provision of power from only the secondary power supply unit.

It shall be understood that the lighting device of claim 1, the lighting device arrangement of claim 10, and the method for operating a lighting device of claim 15, have similar and/or identical preferred embodiments, in particular, as defined in the dependent claims.

It shall be understood that a preferred embodiment of the present invention can also be any combination of the dependent claims or above embodiments with the respective independent claim.

These and other aspects of the invention will be apparent from and elucidated with reference to the embodiments described hereinafter.

DETAILED DESCRIPTION OF EMBODIMENTS

Figure 1:
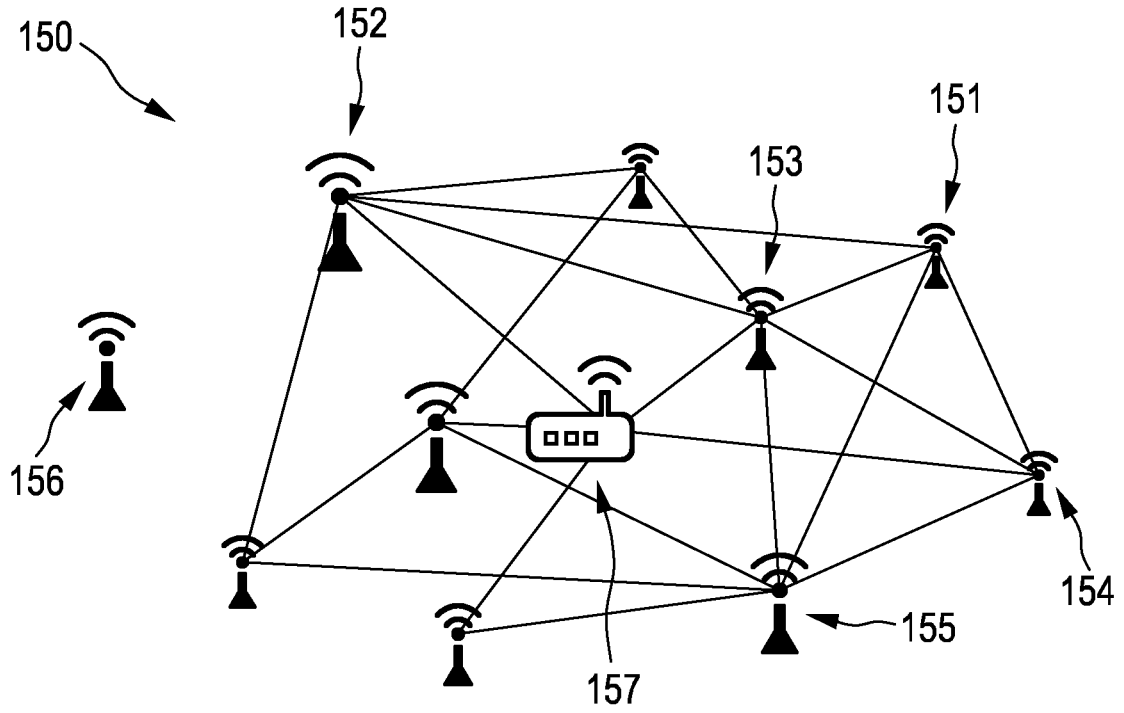
FIG. 1 shows a schematic representation of an embodiment of a lighting device arrangement further comprising a wireless router device.

FIG. 1 shows a schematic representation of an embodiment of a lighting device arrangement 150 comprising a plurality of lighting devices, such as lighting devices 151, 152, 153, 154, 155 and 156, further comprising a wireless-network controller device 157. Connectivity among the devices forming the lighting device arrangement is indicated by lines linking the different devices. For example, lighting device 151 is wirelessly connected to devices 152, 153, 154 and 155. The devices in the lighting arrangement form a wireless mesh network (e.g. ZigBee, Bluetooth, and WiFi). This is a suitable network architecture enabling the connection of many devices. It is less expensive, highly expandable and highly reliable. In mesh networking systems, information travels by being bounced automatically from one device to another next until it reaches its destination. It is not a requirement of such network topology that every device is directly connected to the wireless-network controller device. In the particular example shown in FIG. 1, lighting device 151 is not directly connected to the wireless-network controller device 157. Information intended to be sent to the wireless-network controller device 157 from lighting device 151 reaches wireless-network controller device 157 via lighting devices 152, 153 or 154 by means of a single hop.

With more hops also other signal routes are possible. However, other lighting arrangements have different network topologies, and the choice of a wireless mesh network should be considered as a non-limiting example.

Lighting device 156, however, is not connected to any of other devices in the lighting arrangement nor to the wireless-network controller device 157. The reasons for this lack of connectivity are manifold and include a wrong orientation of a transceiver unit, transmission of wireless signals with an insufficient transmission energy, the device not being configured to communicate in accordance with a predetermined communication protocol used by the lighting arrangement, etc.

Typically, the connectivity of the devices forming part of the lighting device arrangement is tested when the lighting devices are installed at their respective intended location and are being supplied with primary operating power, i.e. operating power from a primary power supply that also provides primary operating power to drive, for instance, a lighting function of the lighting device. Typically, the primary power supply is power mains.

Thus, the effort needed to adapt lighting device 156 to be connected to at least one of the other devices of the lighting device arrangement 150 is high because the lighting device 156 is already installed and connected to the power mains. However, the lighting devices 151-156 are advantageously configured to perform a pre-installation connectivity test routine under supply of only secondary operating power from a secondary power supply unit different from the primary power supply. The pre-installation connectivity test routine is preferably performed when the lighting devices are placed on the floor or any other surface beneath an intended installation location. Any connectivity related problems will then be identified prior to installation. This will be described in more detail with reference to FIG. 2.

Figure 2:
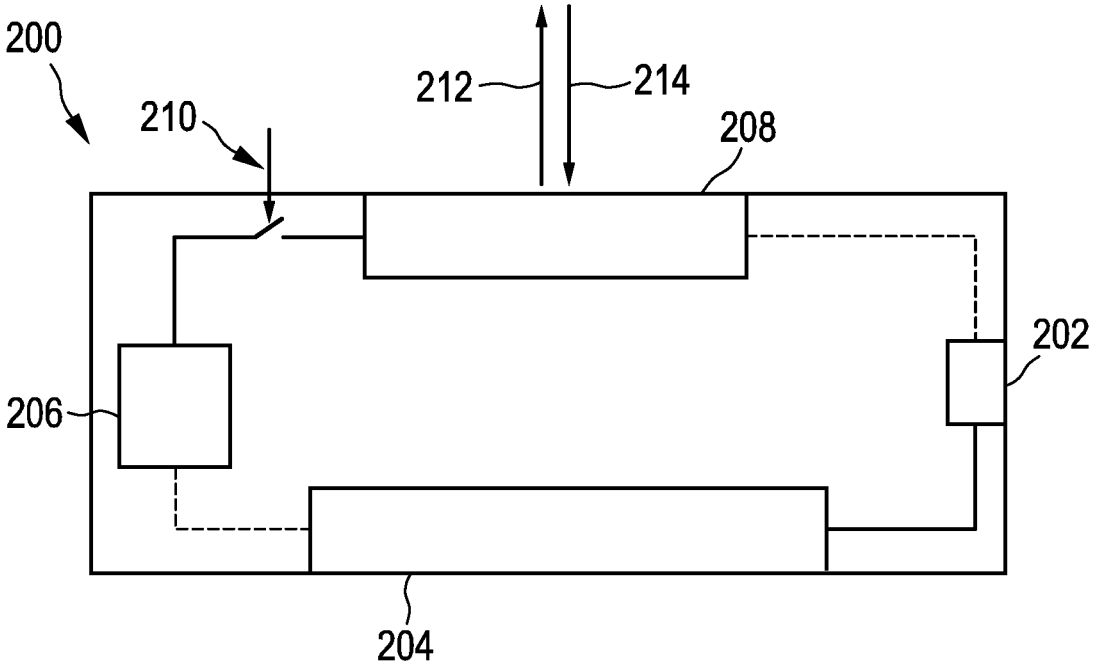
FIG. 2 shows a schematic block diagram of an embodiment of a lighting device.

FIG. 2 shows a schematic block diagram of an embodiment of a lighting device 200. The lighting device 200 comprises a power input unit 202 for reception of primary operating power from an external primary power supply (not shown), such as, but not limited to, mains power. The lighting device also includes a lighting control unit 204, which is connected to the power input unit 202 and configured to control a lighting function of the lighting device under reception of the primary operating power. The lighting function for example includes switching on and off a light source, changing the intensity of the light emitted by the light source, changing a light spectrum of the light emitted by the light source, etc. The lighting device also comprises a secondary power supply unit 206 for storing operating energy and providing secondary operating power in absence of reception of the primary operating power. The secondary power supply unit is configured to provide the secondary operating power to a wireless-transceiver unit 208. The wireless-transceiver unit 208 is configured to perform a pre-installation connectivity test routine under supply of only the secondary operating power. For performing the pre-installation connectivity test routine, the wireless-transceiver unit is configured to generate and transmit, upon detecting reception of a trigger input signal 210, a first wireless test signal 212, to monitor for reception of a second wireless test signal 214 from an external wireless-transceiver unit (not shown), and, upon reception of the second wireless test signal 214, to determine whether or not the received second wireless test signal fulfills predetermined test-signal criteria and to provide an output signal indicative thereof.

In this particular lighting device, the trigger input signal is a result of a user operating a switch connecting the secondary power supply unit to the wireless-transceiver unit.

As stored battery energy is limited, the trigger signal is in some lighting devices configured to start operation of the pre-installation connectivity test routine for a limited time. For instance, installers press a button or otherwise generate the trigger signal by activation, unpacking or suitable placement of the lighting device in a predetermined orientation and after a predetermined time span, e.g., 30 minutes the pre-installation connectivity test routine is automatically deactivated so that no other interaction with the installer is required. Alternatively, the pre-installation connectivity test routine can be deactivated when the lamp gets installed. This may be done manually by toggling an installer switch or automatically by sensing the fixation of the luminaire in the ceiling.

In some lighting devices, the wireless-transceiver unit is further configured to generate, transmit and receive wireless signals in accordance with a predetermined wireless-communication protocol, other than the first or the second wireless test signals, that are used for communicating with other devices in general and peer lighting devices in particular, also under provision of primary operating power, for instance when the lighting device is installed. This is shown in FIG. 2 by the dashed line connecting the power input unit with the wireless-transceiver unit. Additionally, or alternatively, some lighting devices may perform the lighting function using secondary operating power from the secondary power supply unit. For instance, lighting devices configured to act as emergency lighting devices upon failure of primary operating power supply, are configured to obtain the necessary operating power for an emergency lighting function from the secondary power supply unit. This is indicated in the exemplary lighting device 200 of FIG. 2 by the dashed line connecting the secondary power supply unit 206 with the lighting control unit 204.

Figure 3:
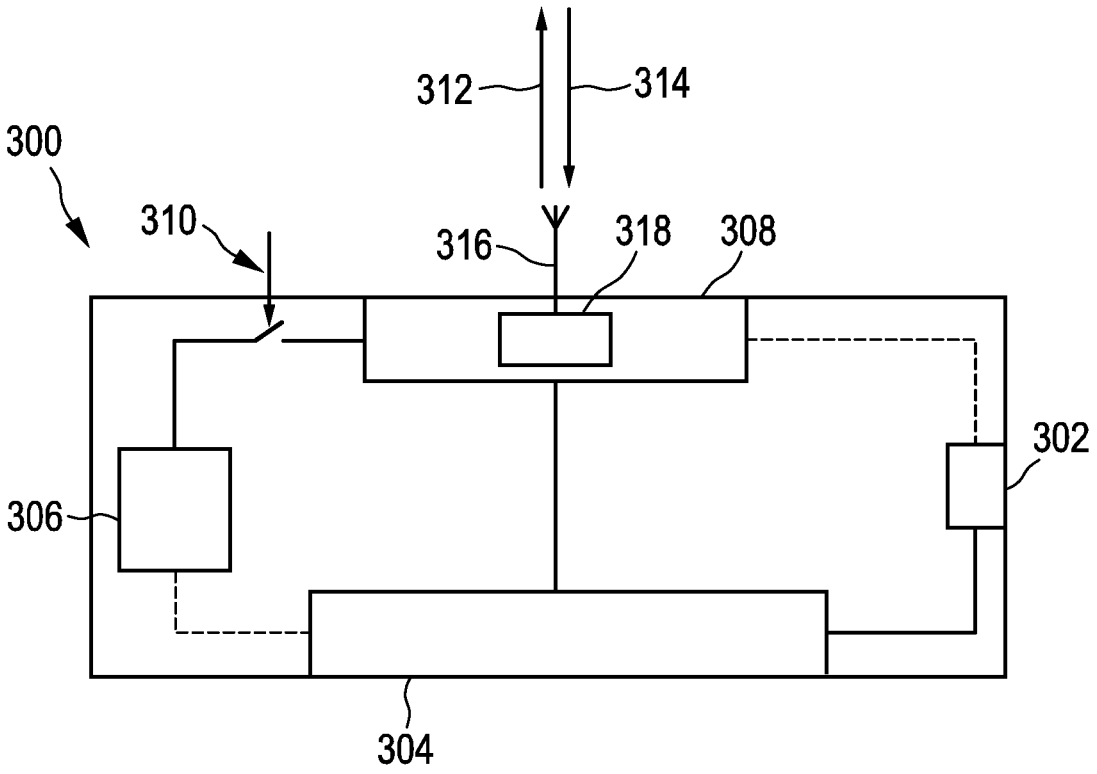
FIG. 3 shows a schematic block diagram of another embodiment of a lighting device.

FIG. 3 shows another embodiment of a lighting device 300. The current discussion will be focused on those technical features distinguishing the lighting device 300 of FIG. 3 from the lighting device 200 of FIG. 2. Those technical features that are identical in lighting devices 200 and 300 will be referred to using the same numerals except for the first digit, which is "2" for the features of lighting device 200 and "3" for the features of lighting device 300.

The wireless-transceiver unit 308 comprises a receiver unit that comprises an antenna 316, the receiver unit having one or more adaptable receiver features. The wireless-transceiver unit 308 also comprises and a transceiver control unit 318 which is configured to adapt at least one of the one or more receiver features in response to the output signal indicating non-fulfillment of the test-signal criteria.

For instance, the receiver unit comprises a reception amplifier unit having a controllable amplifier gain forming one of the adaptable receiver features. In this particular case, the transceiver control unit 318 is configured to increase the amplifier gain of the reception amplifier unit in response to the output signal indicating non-fulfillment of the test-signal criteria. Alternatively, or additionally, the receiver unit of another lighting device has a controllable reception field distribution forming one of the adaptable receiver features. In this lighting device the transceiver control unit is configured to change the reception field distribution of the receiver unit in response to the output signal indicating non-fulfillment of the test-signal criteria.

Another exemplary lighting device comprises a wireless-transceiver unit that alternatively or additionally comprises a transmitter unit having one or more adaptable transmitter features. In this lighting device the transceiver control unit is alternatively or additionally configured to adapt at least one of the one or more transmitter features in response to the output signal indicating non-fulfillment of the test-signal criteria. A non-limiting example of an adaptable transmitter feature is a controllable transmission field distribution.

In yet another lighting device, the wireless-transceiver unit is additionally configured, upon detecting non-fulfillment of the test-signal criteria, to generate and transmit a power-increase signal indicative of an instruction to increase a transmission energy of the second wireless test signal.

Thus, when any of these lighting devices start the performance of the pre-installation connectivity test routine but does not receive any second wireless test signal from an external device, are configured to adapt the wireless transceiver unit 308 so as to increase the chance of receiving a suitable second wireless test signal that fulfills the test-signal criteria.

Figure 4:
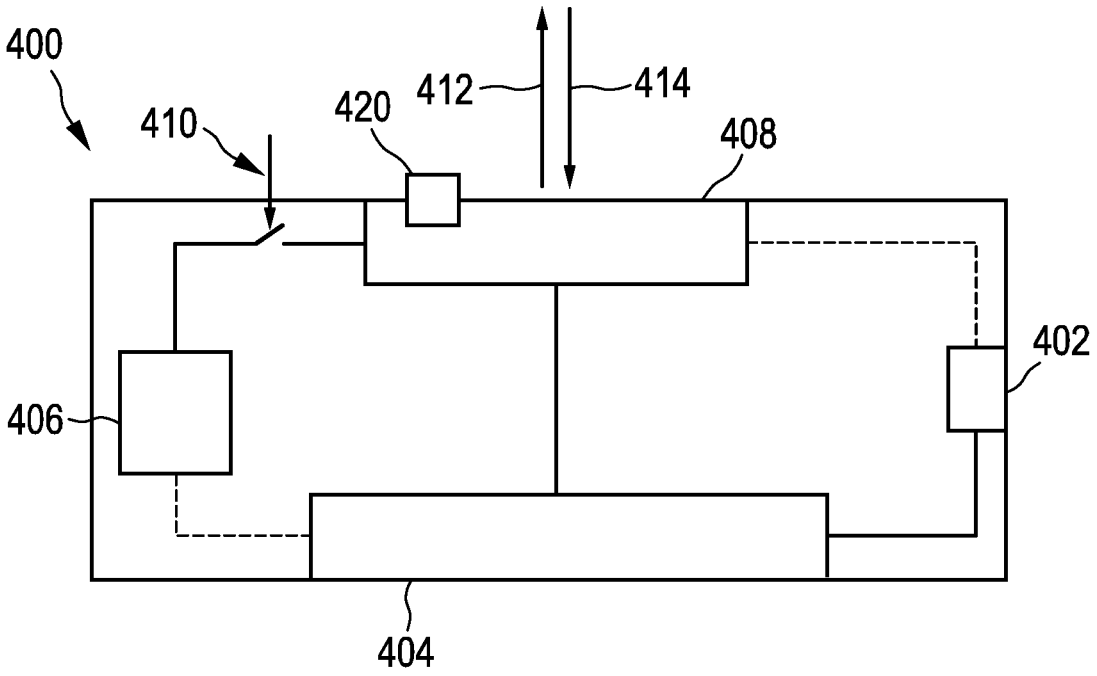
FIG. 4 shows a schematic block diagram of another embodiment of a lighting device.

FIG. 4 shows a schematic block diagram of a technologically simpler lighting device 400 than lighting device 300. Here again, the discussion will be focused on those technical features distinguishing the lighting device 400 of FIG. 4 from the lighting device 200 of FIG. 2. Those technical features that are identical in lighting devices 200 and 400 will be referred to using the same numerals except for the first digit, which is "2" for the features of lighting device 200 and "4" for the features of lighting device 400. The lighting device 400 comprises a user interface 420 connected to the secondary power supply unit 406 and configured to receive the output signal and to provide a perceivable output indicative thereof. For instance, user interface 420 comprises a LED that emits light upon determining non-fulfillment of the test-signal criteria. The LED thus provides a perceivable output that informs the installer that the lighting device has not received any second wireless test signal fulfilling the test-signal criteria, which indicates poor connectivity.

Preferably, lighting devices are configured to both adapt at least one of the one or more receiver features of the receiver unit or of the transmitter unit or of both the receiver unit and the transmitter unit and to provide a perceivable output indicative of whether or not the received second wireless test signal fulfills predetermined test-signal criteria via a user interface.

Figure 5:
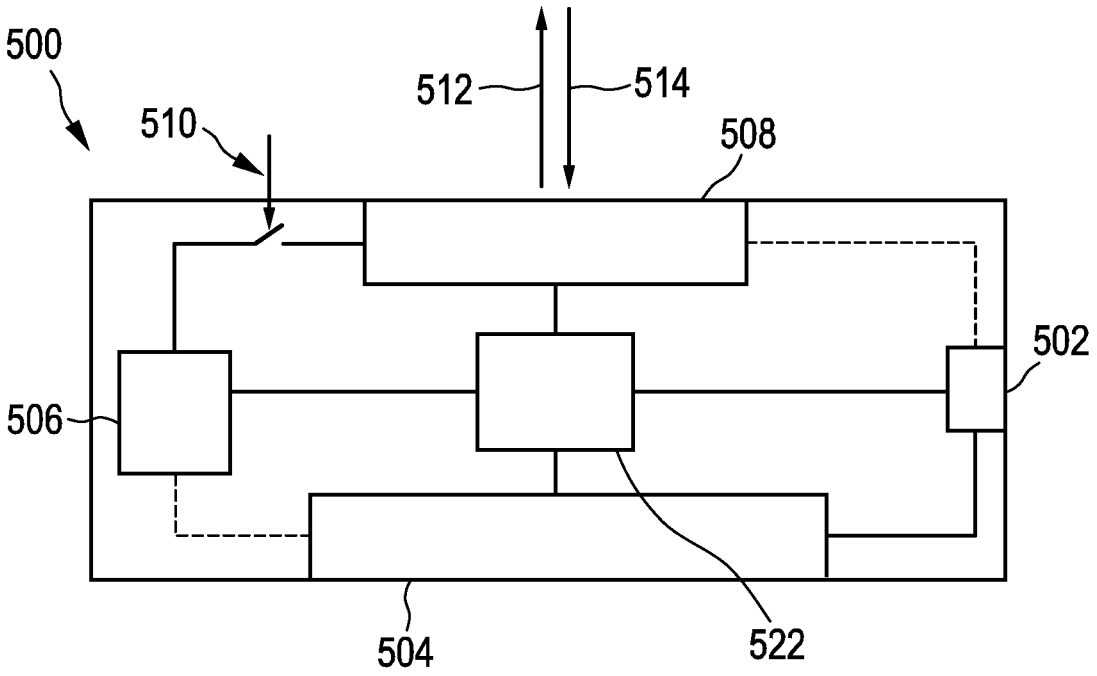
FIG. 5 shows a schematic block diagram of another embodiment of a lighting device.

FIG. 5 shown a schematic block diagram of a lighting device 500. Here again, the discussion will be focused on those technical features distinguishing the lighting device 500 of FIG. 5 from the lighting device 200 of FIG. 2. Those technical features that are identical in lighting devices 200 and 500 will be referred to using the same numerals except for the first digit, which is "2" for the features of lighting device 200 and "5" for the features of lighting device 500. Lighting device 500 further comprises an operation control unit 522, which is connected with the power input unit and to the secondary power supply unit configured to control operation of the lighting device 500 in a first operational mode, which is associated with reception of the primary operating power via the power input unit 502 and in which operation of the lighting control unit 504 is allowed, and, to control operation of the lighting device in a second operational mode, which is associated with provision of only the secondary operating power in absence of reception of the primary operating power, and in which operation of the wireless-transceiver unit 508 for performing the pre-installation connectivity test routine is allowed, but operation of the lighting control 504 unit is not allowed.

Figure 6:
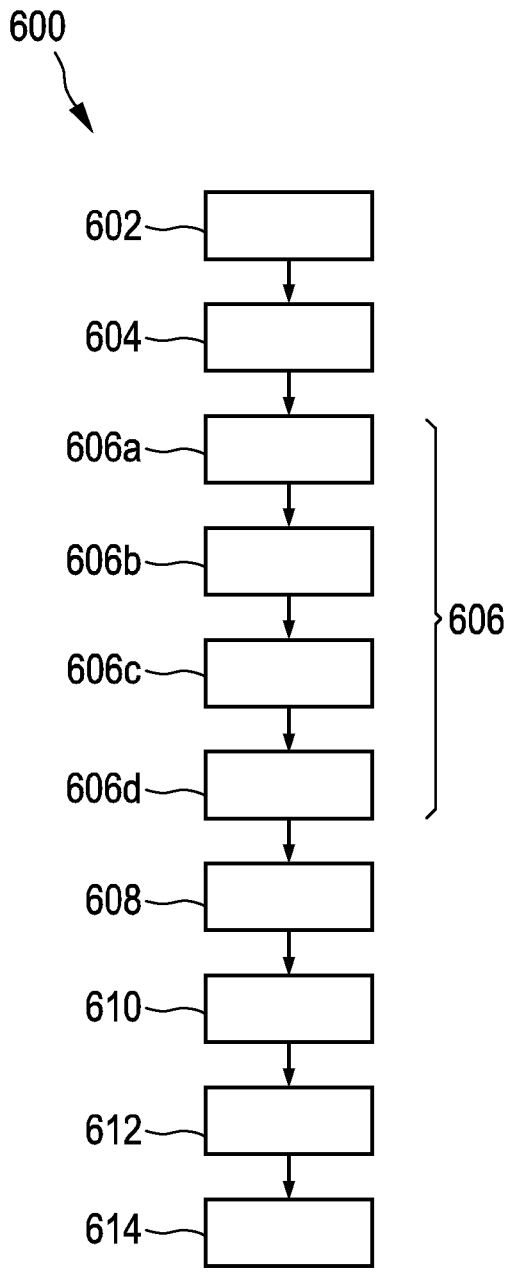
FIG. 6 shows a flow diagram of a method for operating a lighting device.

FIG. 6 shows a flow diagram of a method 600 for operating a lighting device. The method 600 includes, in a step 602, providing a lighting control unit for controlling a lighting function of the lighting device under reception, via a power input unit, of primary operating power from an external primary power supply. It also comprises, in a step 604, providing, in absence of a connection to the primary power supply device, secondary operating energy from a secondary power supply unit to a wireless-transceiver unit. Further the method comprises, in a step 606 performing a pre-installation connectivity test routine under supply of only the secondary operating power, wherein the pre-installation connectivity test routine comprises detecting 606*a* reception of a trigger input signal, generating and transmitting 606*b* a first wireless test signal, monitoring 606*c* for reception of a second wireless test signal from an external wireless-transceiver unit, and determining and providing 606*d* an output signal indicative of whether or not the received second wireless test signal fulfills predetermined test-signal criteria.

The method 606 may optionally comprise a step 608 in which at least one adaptable receiver feature of a receiver unit or at least one adaptable transmitter feature of a transmitter unit of the wireless-transceiver unit is adapted in response to the output signal indicating non-fulfillment of the test-signal criteria.

Additionally, or alternatively, the method may also comprise a step 610, during which upon detecting non-fulfillment of the test-signal criteria, a power increase signal indicative of an instruction to increase a transmission energy of the second wireless test signal is generated and transmitted.

Additionally, or alternatively, the method may also comprise a step 612 during which a perceivable output indicative of the output signal is provided via a user interface.

Additionally, or alternatively, the method may also comprise a step 614, during which a networking connection with one or more external wireless-transceiver units under provision of power from only the secondary power supply unit is established in compliance with a predetermined network protocol.

In summary, a lighting device is provided that comprises a power input unit for reception of primary operating power from an external primary power supply, a lighting control unit connected to the power input unit and configured to control a lighting function of the lighting device, a secondary power supply unit for storing operating energy and providing secondary operating power in absence of reception of the primary operating power, a wireless-transceiver unit, which is configured, in performing a pre-installation connectivity test routine under supply of only the secondary operating power, to generate and transmit, upon detecting reception of a trigger input signal, a first wireless test signal, to monitor for reception of a second wireless test signal from an external wireless-transceiver unit; and to determine whether or not the received second wireless test signal fulfills predetermined test-signal criteria and to provide an output signal indicative thereof.

In the claims, the word "comprising" does not exclude other elements or steps, and the indefinite article "a" or "an" does not exclude a plurality.

A single step or other units may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A lighting device, comprising:

a power input unit for reception of primary operating power from an external primary power supply;

a lighting control unit which is connected to the power input unit and configured to control a lighting function of the lighting device under reception of the primary operating power;

a secondary power supply unit for storing operating energy and providing secondary operating power in absence of reception of the primary operating power;

a wireless-transceiver unit, which is configured for performing a pre-installation connectivity test routine under supply of only the secondary operating power:

to generate and transmit, upon detecting reception of a trigger input signal, a first wireless test signal;

to monitor for reception of a second wireless test signal from an external wireless-transceiver unit;

upon reception of the second wireless test signal, to determine whether or not the received second wireless test signal fulfills predetermined test-signal criteria and to provide an output signal indicative thereof; and an operation control unit, which is connected with the power input unit and configured to control operation of the lighting device in a first operational mode, which is associated with reception of the primary operating power via the power input unit and in which operation of the lighting control unit is allowed, and, to control operation of the lighting device in a second operational mode, which is associated with provision of only the secondary operating power in absence of reception of the primary operating power, and in which operation of the wireless-transceiver unit for performing the pre-installation connectivity test routine is allowed, but operation of the lighting control unit is not allowed.

2. The lighting device of claim 1, wherein the wireless-transceiver unit comprises a receiver unit having one or more adaptable receiver features, and a transceiver control unit which is configured to adapt at least one of the one or more receiver features in response to the output signal indicating non-fulfillment of the test-signal criteria.

3. The lighting device of claim 1, wherein the wireless-transceiver unit comprises a transmitter unit having one or more adaptable transmitter features, and a transceiver control unit configured to adapt at least one of the one or more transmitter features in response to the output signal indicating non-fulfillment of the test-signal criteria.

4. The lighting device of claim 2, wherein the receiver unit comprises a reception amplifier unit having a controllable amplifier gain forming one of the adaptable receiver features, and wherein the transceiver control unit is configured to increase the amplifier gain of the reception amplifier unit in response to the output signal indicating non-fulfillment of the test-signal criteria.

5. The lighting device of claim 3, wherein:

the receiver unit has a controllable reception field distribution forming one of the adaptable receiver features;

the transmitter unit has a controllable transmission field distribution forming one of the adaptable transmitter features; and wherein the transceiver control unit is configured to change the reception field distribution or the transmission field distribution or both the reception field distribution and the transmission field distribution in response to the output signal indicating non-fulfillment of the test-signal criteria.

6. The lighting device of claim 1, wherein the wireless-transceiver unit is further configured, upon detecting non-fulfillment of the test-signal criteria:

to generate and transmit a power-increase signal indicative of an instruction to increase a transmission energy of the second wireless test signal.

7. The lighting device of claim 1, further comprising a user interface connected to the secondary power supply unit and configured to receive the output signal and to provide a perceivable output indicative thereof.

8. The lighting device of claim 1, wherein the wireless-transceiver unit is configured to establish, in compliance with a predetermined network protocol, a networking connection with one or more external wireless-transceiver units under provision of power from only the secondary power supply unit.

9. The lighting device of claim 1, wherein the secondary power supply unit comprises a battery.

10. A lighting device arrangement, comprising a plurality of lighting devices according to claim 1.

11. A method for operating a lighting device, comprising:

providing a lighting control unit for controlling a lighting function of the lighting device under reception, via a power input unit, of primary operating power from an external primary power supply;

providing, in absence of a connection to the primary power supply device, secondary operating energy from a secondary power supply unit to a wireless-transceiver unit of the lighting device;

the wireless-transceiver unit performing a pre-installation connectivity test routine under supply of only the secondary operating power, wherein the pre-installation connectivity test routine comprises:

detecting reception of a trigger input signal;

generating and transmitting a first wireless test signal;

monitoring for reception of a second wireless test signal from an external wireless-transceiver unit;

determining and providing an output signal indicative of whether or not the received second wireless test signal fulfills predetermined test-signal criteria;

providing an operation control unit, which is connected with the power input unit;

controlling, via the operation control unit, operation of the lighting device in a first operational mode, which is associated with reception of the primary operating power via the power input unit and in which operation of the lighting control unit is allowed, and controlling, via the operation control unit, operation of the lighting device in a second operational mode, which is associated with provision of only the secondary operating power in absence of reception of the primary operating power, and in which operation of the wireless-transceiver unit for performing the pre-installation connectivity test routine is allowed, but operation of the lighting control unit is not allowed.

12. The method of claim 11, further comprising adapting at least one adaptable receiver feature of a receiver unit of the wireless-transceiver unit or at least one adaptable transmitter feature of a transmitter unit of the wireless-transceiver unit in response to the output signal indicating non-fulfillment of the test-signal criteria.

13. The method of claim 11, further comprising, upon detecting non-fulfillment of the test-signal criteria, generating and transmitting a power increase signal indicative of an instruction to increase a transmission energy of the second wireless test signal.

14. The method of claim 11, further comprising establishing, in compliance with a predetermined network protocol, a networking connection with one or more external wireless-transceiver units under provision of power from only the secondary power supply unit.

* * * * *